United States Patent [19]

Weber

[11] 4,420,919

[45] Dec. 20, 1983

[54] WALL OPENING FRAME MEMBER

[75] Inventor: Ronald J. Weber, Wausau, Wis.

[73] Assignee: Wausau Metals Corporation, Wausau, Wis.

[21] Appl. No.: 293,168

[22] Filed: Aug. 17, 1981

[51] Int. Cl.[3] ..... E06B 1/04

[52] U.S. Cl. ..... 52/204

[58] Field of Search ..... 52/204, 211, 311, 312, 52/309.1, 309.5, 716, 717; 49/503, 504, DIG. 1

[56] References Cited

U.S. PATENT DOCUMENTS

| | | | |
|---|---|---|---|
| 2,913,777 | 11/1959 | Viets | 52/211 |
| 3,042,160 | 7/1962 | Price | 52/717 |
| 3,042,160 | 7/1962 | Price | 52/717 |
| 3,204,324 | 9/1965 | Nilsen | 29/155 R |
| 3,298,147 | 1/1967 | Haberman | 52/717 |
| 3,408,250 | 10/1968 | Finefrock | 52/717 |
| 3,732,138 | 5/1973 | Almog | 52/309.5 |
| 3,797,185 | 3/1974 | LaBorde | 52/716 |
| 3,815,285 | 6/1974 | Kuyper | 52/716 |
| 4,309,845 | 1/1982 | Schmidt | 49/DIG. 1 |

OTHER PUBLICATIONS

Frame Sample; Miller Industries Inc., Miami, Florida 33169 Shown in FIG. A of Citation of Prior Art.

*Primary Examiner*—Peter M. Caun

*Attorney, Agent, or Firm*—Isaksen, Lathrop, Esch, Hart & Clark

[57] ABSTRACT

A wall opening frame member (10, 79) for framing doors, windows, and the like having an exterior side (14) and an interior side (16). The frame member (10) has a metal frame (18) that preferably has at least one structural heat transfer barrier (52, 62) whereby no unbroken metallic heat transfer path exists between the exterior side (14) and the interior side (16). A wood facing (20) is adapted to cover all substantial interior surfaces of the metal frame (18) when the metal frame (18) is in use. Means are provided for attaching wood facing (20) to the interior surfaces of the metal frame (18) so that no substantial surface of the metal frame (18) is exposed to the inside ambient air and the transfer of heat between the exterior side and the interior ambient air of the frame member (10) is inhibited. Preferably, the means for attaching the wood facing (20) includes an elastic and deformable foam body (68) attached on opposite side surfaces by a selected adhesive to the wood facing (20) and the metal frame (18) to further inhibit heat flow and to compensate for temperature and humidity caused dimensional changes in the metal frame (18) and the wood facing (20).

5 Claims, 3 Drawing Figures

WALL OPENING FRAME MEMBER

TECHNICAL FIELD

The present invention relates to wall opening frame members and particularly to wall opening frame members having reduced heat transfer characteristics.

BACKGROUND ART

The prior art is generally cognizant of metal frame members used for framing doors, windows, and the like. Commonly such frames are made by extruding aluminum or other selected metals. Such frames are strong, dimensionally accurate, and resist the effects of water and weather. However, because metal is a good heat conductor, they present difficulties when outside temperatures differ from those within the building equipped with such a frame. In the winter, the frames are cold, and water condensation and frost commonly form on their interior surfaces, leading both to water damage and to increased cost of heating. When exterior temperatures are warm in comparison with the temperatures inside the building, heat transferred through the frames into the building increases the cost of air conditioning and the like.

The prior art is cognizant of combining wood framing members with metal frames for aesthetic purposes. See Price, U.S. Pat. No. 3,042,160. The frame arrangement shown in Price provides for a partial covering of a prefabricated metal frame with wood trim pieces. However, the metal frame in Price has an uninterrupted metal heat flow path between substantial exposed exterior and interior parts. Metal is also visible from inside the window or other opening equipped with the Price frame.

The prior art is also cognizant of the use of structural heat transfer barriers incorporated in the metallic parts of metal framing members. See Nilson, U.S. Pat. No. 3,204,324. Such structural heat transfer barriers serve to thermally insulate inner parts of the frame from outer parts so that there is no continuous, metallic path by which heat can flow between the interior and exterior parts of the frame. Such framing members exhibit greatly improved heat flow characteristics over comparable framing members having no structural heat transfer barriers. However, with fuel costs escalating rapidly, even better systems are required to reduce heat transfer through wall opening frame members, particularly when temperature differences are extreme between the exterior and interior of the building in which such a framing member is mounted. In addition, the metal framing of Nilson may be esthetically objectionable in many building environments where wood framing members have traditionally been employed, even though metal members may be structurally superior.

Accordingly a need exists for a wall opening frame member which conbines the structural strength, dimensional accuracy and lonevity of metal with the insulating and esthetic qualities of wood.

DISCLOSURE OF THE INVENTION

The present invention is summarized in that a frame member for framing doors, windows, and the like has a metal frame having an exterior side and an interior side with interior surfaces. A wood facing is adapted to cover all of the interior surfaces of the metal frame when the metal frame is in use. The invention further includes means for attaching the wood facing to the interior surfaces so that no portion of the interior surfaces are exposed to the interior ambient air. Preferably, a structural heat transfer barrier separates the exterior side of the frame from the interior side of the frame, whereby no continuous metal heat transfer path exists between the exterior side and the interior side uninterrupted by the structural heat transfer barrier and the wood facing.

A primary object of the invention is to provide a framing member having the strength, dimensional stability, and weather resisting characteristics of a metal frame, but with a reduced potential for heat transfer between exterior and interior parts of the frame.

A second object of the invention is to provide a metal wall opening frame member employing structural metal combined with wood facing such that substantially no metal surface of the frame will be exposed to the interior ambient air.

Another object of the invention is to provide a wall opening frame member employing structural metal in which all interior metal surfaces are covered by an insulating layer of wood secured to the metal by an adhesive coated flexible foam tape.

Other objects, features, and advantages of the invention will be apparent from the following detailed description taken in conjunction with the accompanying drawings showing a preferred embodiment of a wall opening frame member exemplifying the principles of the invention.

BEST MODE FOR CARRYING OUT THE INVENTION

Figure 1:
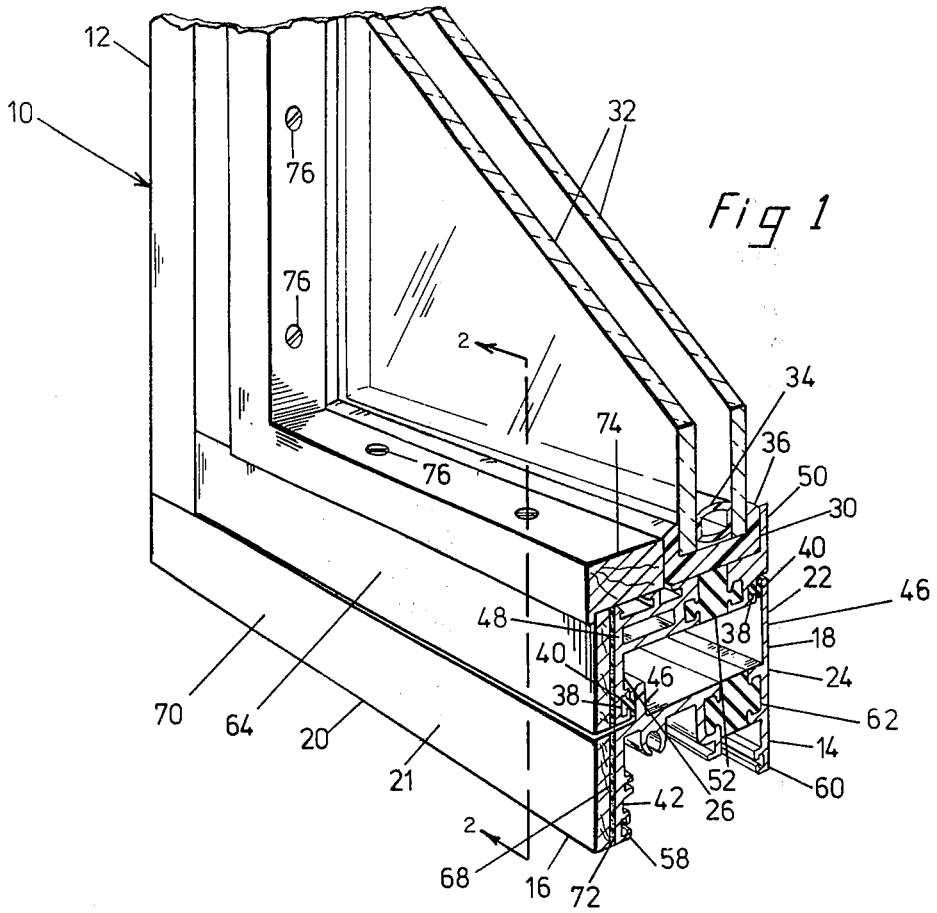
FIG. 1 is a perspective view of a broken away portion of a window frame employing frame members made in accordance with the invention.
Figure 2:
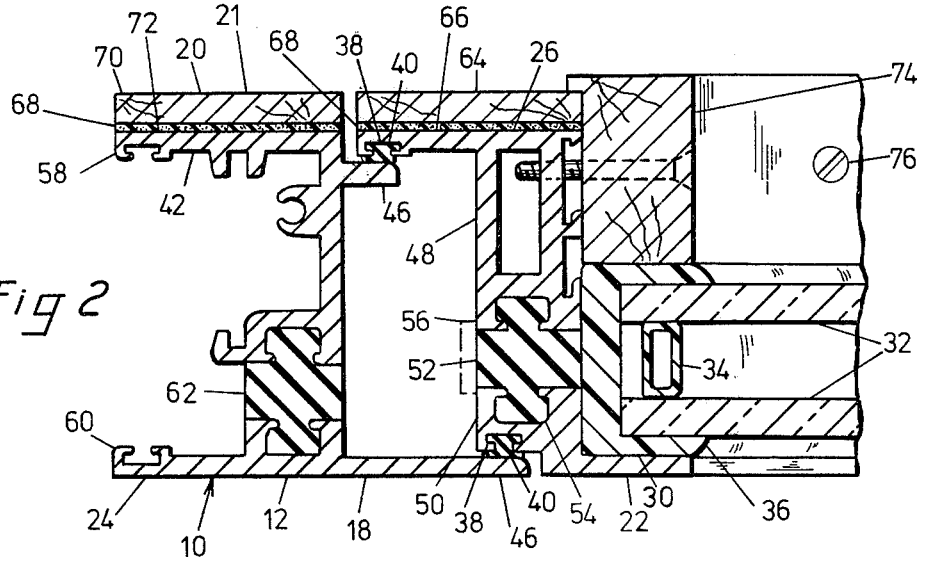
FIG. 2 is a cross-sectional view of the window frame shown in FIG. 1 taken along section lines 2—2.

Referring more particularly to the drawings, wherein like numbers refer to like parts, FIGS. 1 and 2 illustrate a preferred embodiment of the improved wall opening frame member of the invention shown generally at 10, incorporated in a window frame 12. The window frame 12 has an exterior side 14 and an interior side 16.

The wall opening frame member 10 of the invention combines a metal frame 18 with a wood facing 20 that is securely attached to the metal frame. In the window frame embodiment of FIG. 1, the metal frame 18 has a sash member 22 that is attached to a casing member 24 in hinged relation. The sash member 22 has open and closed positions and is adapted to open inwardly. The wood facing 20 is secured to both the casing number 24 and the sash member 22 as will be more fully explained below.

Selected surfaces of the sash member 22 define a glazing channel 30 opening away from the casing member 24. The glazing channel 30 receives at least one and preferably two or more panes of glass 32. The panes of glass 32 are separated by a spacer 34, to create an insulating air space between the panes in a conventional manner, and are sealed in air tight relation to the glazing channel 30 by conventional caulking 36. The sash member 22 has an interior sash face member 26, which is the most interiorly extending part of the sash member 22. The sash member 22 has at least one and preferably two weather strip channels 38 adapted to receive and hold weather stripping 40.

The casing member 24 has an interior casing face member 42 which is the most interiorly extending part of the casing member 24. The casing member 24 has stops 46 adapted to engage the weather stripping 40 in air tight relation when the sash member 22 is in its closed position.

Preferably the sash 22 has interior and exterior metal sash structures 48 and 50 rigidly connected and spaced from each other by a sash structural heat transfer barrier 52 integrally joined to the spaced sash structures in a known manner. The structural heat transfer barrier 52 is made from a polyurethane resin or other suitable material having a substantially lower heat conductivity than the metal sash structures 48 and 50. Thus, the structural heat transfer barrier 52 interrupts the path through the metal sash structures 48 and 50 by which heat could otherwise readily flow between the interior side 16 and exterior side 14 of the window frame 12. In practice, the interior and exterior sash structures 48 and 50 are originally formed as a single metal extrusion having a channel 54 partially defined by a metal bridge 56 (shown in phantom in FIG. 2), which metal bridge connects the interior and exterior sash structures 48 and 50. Polyurethane resin or a comparable material is then flowed into the channel 54 and allowed to polymerize. The metal bridge 56 is then removed by milling. Preferably, the sash structural heat transfer barrier 52 defines part of the glazing channel 30 so that no metal part of the sash 22 extends entirely from one side of the panes of glass 32 to the other side.

The casing 24 similarly has interior and exterior casing structures 58 and 60 rigidly connected and spaced from each other by a comparable casing structural heat transfer barrier 62. The casing structural heat transfer barrier 62 interrupts the metal heat flow path through the casing 24 by which heat could otherwise readily flow between the exterior side 14 and the interior side 16 of the window frame 12.

The wood facing 20 includes a cover piece 21 that is coextensive with the inwardly facing surfaces of the metal frame 18. When the metal frame 18 is divided into a sash member 22 and a casing member 24, as in the embodiment shown at 10, the cover piece 21 includes a wood sash cover 64 having a selected thickness that is coextensive with the inwardly facing surface 66 of the interior sash face member 26. The sash cover 64 may be attached to the surface 66 in a manner wherein no part of the surface 66 is exposed to the ambient interior air. The cover piece 21 also includes a wood casing cover 70 having a selected thickness. The casing cover 70 is coextensive with the inwardly facing surface 72 of the interior casing face member 42. The casing cover 70 is attached to the surface 72 in a manner comparable to that in which the sash cover 64 is attached to the surface 66 of the interior sash face member 26.

The preferred means for attaching the sash cover 64 to the interior sash face member 26 and the casing cover 70 to the interior casing face member 42 is a tape having a foam body 68 with a selected adhesive on each side thereof. The foam body 68 provides an additional substantial insulating factor and serves as an additional means to interrupt any heat flow path between the exterior side 14 and interior side 16 of the window frame 12. Additionally, metals commonly used in window frames and wood expand at different rates in response to thermal change, and wood tends to swell and contract in response to changes in humidity while metal does not. Consequently, the foam body 68 is selected to be sufficiently elastic and deformable that the dimensional changes in the metal and wood parts referred to are insufficient to disengage those parts from the tape. Where the insulating and elastic properties of the foam tape are not desired by the end user, other attachment means, such as adhesive, mastic or screws may be employed to attach the cover piece to the interior frame surfaces, with substantial realization of the objectives of the invention.

The wood facing 20 in the embodiment of FIGS. 1 and 2 also includes a wood bead 74 that extends the length of the frame member 10. The wood bead 74 extends from the glazing channel 30 interiorly at least as far as the interior surface 66 of the interior sash face member 26 to completely cover all metal frame surfaces extending interiorly from the interior glass frame 32 which would otherwise be exposed to the interior ambient air. Preferably, the wood bead 74 further extends over the sash cover 64 for a selected distance to provide an overlapping insulating joint. The wood bead 74 is attached to the sash 22 by any conventional means of attachment, such as the screws 76 shown or foam bodied tape as described above.

Figure 3:
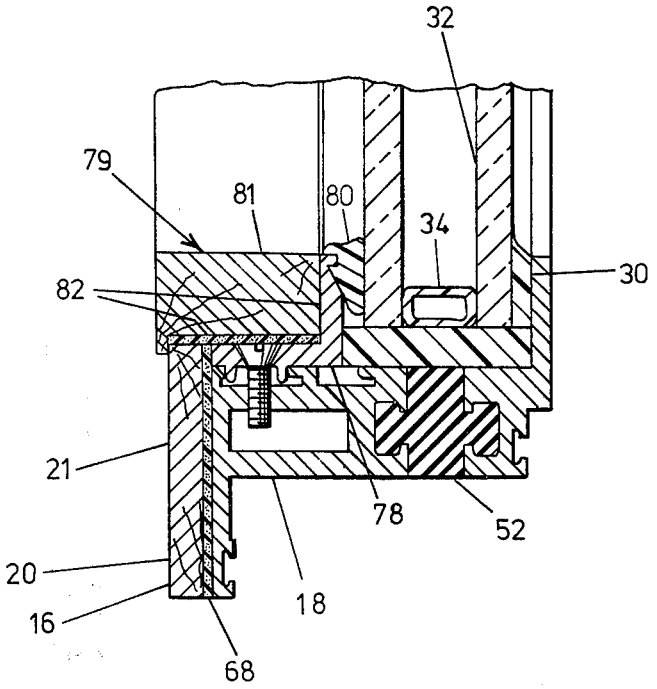
FIG. 3 is a cross-sectional view analogous to the view of FIG. 2 of an alternative embodiment of a frame member made in accordance with the invention.

In the embodiment of the metal frame member of the invention shown at 10 in FIGS. 1 and 2, the caulking 36 fills the space between the wood bead 74 and the panes of glass 32, a surface of the wood bead 74 effectively serving to define a part of the glazing channel 30. However, in some installations a metal bead of conventional sorts may be preferred. Accordingly, the metal bead 78 shown in the embodiment of the invention (designated generally as 79) illustrated in FIG. 3 may be attached to the sash 22, with the panes of glass 32 sealed thereto by any conventional means, such as caulking or the flexible gasket 80 shown in FIG. 3. A wooden bead cover 81 coextensive with the interiorly exposed surfaces 82 of the metal bead 78 is attached thereto by foam tape, mastic, screws, or other conventional means so that no metallic surface remains exposed to the ambient air on the interior side of the metal frame member. In all other features and parts shown, the embodiment at 79 in FIG. 3 corresponds with that shown at 10, and like parts are given like numbers.

When it is anticipated that the temperature difference between the interior and exterior sides of the wood-faced metal frame member 10 will be extreme or time extended, it would be appropriate to employ a combination of at least one structural heat transfer barrier, wood facing, and an insulating foam tape, all as described above, to achieve the maximum benefits of the invention. However, in applications where temperature differences are anticipated to be less extreme, it may be sufficient in order to achieve an adequately reduced heat flow through the metal frame member to employ a structural heat transfer barrier and wood facing, using noninsulating means of attaching the wood facing to the metallic parts of the frame. Likewise, it may be sufficient in certain applications to employ wood facing covering all substantial interior facing metal surfaces, with or without a foam tape means of attachment, with no structural heat transfer barrier in the metal frame. So long as wood facing is used whereby no metallic interior surface is left exposed, any of the alternatives referred to above are within the scope and spirit of the invention.

The following table of data shows the heat-flow characteristics of several alternative embodiments of the invention:

The heat transmitting characteristics of a sample of the embodiment shown in FIG. 1 of the wall opening frame member 10 of the invention were measured under test conditions and compared with the heat transmitting characteristics of a metallic wall opening frame member. The metallic wall opening frame member corresponded substantially to the embodiment of the wall opening frame member 10 of the invention shown in FIG. 1 except that no wooden cover piece 21 or insulating foam body 68 were included, and the wood bead 74 was replaced by a conventional, snap-in metallic bead. Each wall opening frame member was fashioned into a double-glazed window of the sort shown in FIG. 1. Certain data generated by the test is set forth in the table below, wherein the window fashioned from the wall opening frame member 10 of the invention is identified as the "invented frame" and the compared window is referred to as the "conventional frame." The tests were conducted by an independent test laboratory in accord with the *Standards and Tests of Thermal-Performance of Residential Insulated Windows and Sliding Glass Doors,* promulgated and published by the Architectural Aluminum Manufacturers Association. The warm side ambient air temperature was approximately 70° F. and the cold side ambient air temperature was approximately 18° F. The windows were tested under conditions simulating a wind velocity of 15 miles per hour.

| Characteristic | Invented Frame | Conventional Frame |
|---|---|---|
| Overall heat-transfer coefficient "U" calculated for the nominal area | 0.52 BTU/hr/sq ft/°F. | 0.65 BTU/hr/sq ft/°F. |
| Average frame temperature "FT" | 47.5° F. | 45.4° F. |
| Overall condensation resistence factor "CRF" based on average frame temperature "FT" | 59 | 55 |
| Surface temperature at selected location on interior frame | 49.1° F. | 46.0° F. |
| Local U value at the selected interior location | 0.553 BTU/hr/sq ft/°F. | 0.647 BTU/hr/sq ft/°F. |
| Calculated exterior temperature at which condensation would begin on the interior frame at the selected location (assumed interior relative humidity of 30%) and interior temperature of 70° | −16° F. | −4° F. |

It will be noted that the overall heat transfer coefficient "U" of the window made with the embodiment of the wall opening frame member 10 of the invention shown in FIG. 1 is only 80% of the corresponding characteristic of the window made from the conventional frame. The reduction in the U value of the frame corresponds to a significant energy savings attributable to the invention. Furthermore, the fact that exterior temperatures may be considerably lower before condensation begins to appear on interior frame surfaces of a window made with the wall opening frame member 10 of the invention substantially reduces the likelihood of undesirable interior condensation which is both unsightly and a maintenance nuisance, and may result in damage to interior wall surfaces or ice formation which will restrict movement of the sash member 22. An important feature of the invention contributing to this desirable effect is that the wood facing 20 is adapted to cover all substantial interior surfaces 62, 72, 82 of the metal frame 18 when the metal frame is in use. If any substantial part of the metal frame 18 is left uncovered, that part becomes a source of condensation that may have the undesirable effect referred to and may also damage the wood facing 20, itself.

All metallic frame parts discussed above may be conveniently made by conventional extrusion techniques. The wooden parts referred to above may be made by conventional wood-forming techniques. Frame members may be made with or without a separate sash and casing and may be adapted to frame any door, window, or the like. It is understood that the invention is not confined to the particular construction, materials, and arrangement of parts herein illustrated and described and that various changes may be made without departing from the spirit of the invention. The invention embraces all such modified forms thereof as come within the scope of the following claims.

What is claimed is:

1. A wall opening frame member (10, 79) for framing doors, windows, and the like, comprising:

(a) a metal frame (18) having an exterior side (14) and an interior side (16) with interior surfaces (66, 72, 82);

(b) a wood facing (20) adapted to cover all substantial interior surfaces (66, 72, 82) of the metal frame (18) when the metal frame (18) is in use; and (c) means for attaching the wood facing (20) to the interior surfaces (66, 72, 82) so that no substantial surface of the metal frame (18) is exposed to the inside ambient air and no continuous metallic heat transfer path exists between the exterior side (14) and the inside ambient air uninterrupted by the wood facing (20), including an insulating foam body (68) with an adhesive on each side of the body, the adhesive sides respectively attached to the wood facing (20) and the metal frame (18) so that heat transfer between the exterior and interior sides (14 and 16) is further reduced by the insulating foam body, the foam body being selected to be sufficiently elastic and deformable that thermal dimensional changes in the wood facing (20) and metal frame (18) are insufficient to disengage those parts from the foam body.

2. A wall opening frame member (10, 79) for framing doors, windows, and the like, comprising:

(a) a metal frame (18) having an exterior side (14) and an interior side (16) with interior surfaces (66, 72, 82) and at least one structural heat transfer barrier (52, 62) separating the exterior and interior sides (14, 16), whereby no continuous metallic heat transfer path exists between the exterior side (14) and the interior side (16);

(b) a wood facing (20) adapted to cover all interior surfaces of the metal frame (18) when the metal frame (18) is in use; and (c) means for attaching the wood facing (20) to the interior surfaces so that no substantial surface of the metal frame (18) is exposed to the inside ambient air, whereby the transfer of heat between the exterior side of the frame member (10) and the inside ambient air is inhibited by the combination of the structural heat transfer barrier (52, 62) and wood facing (20), including an insulating foam body (68) with an adhesive on each side of the body, the adhesive sides respectively attached to the wood facing (20) and the metal frame (18) so that heat transfer between the exterior and interior sides (14 and 16) is further reduced by the insulating foam body, the foam body being selected to be sufficiently elastic and deformable that thermal dimensional changes in the wood facing (20) and metal frame (18) are insufficient to disengage those parts from the foam body.

3. The wall opening frame member (10) specified in claim 1 or 2 wherein (a) the metal frame (18) has inwardly facing surfaces (66, 72) and surfaces (82) extending from the inwardly facing surfaces toward a glazing channel (30) defined by the metal frame (18) and adapted to receive a selected number of panes of glass (32) to form a window; and (b) the wood facing (20) includes a cover piece (21) coextensive with the inwardly facing surfaces (66, 72) of the metal frame (18), and a wood bead (74) adapted to extend from the cover piece (21) to the glazing channel (30) and cover the metal frame surfaces (82) extending therebetween.

4. The wall opening frame member (10) specified in claim 3 wherein (a) the metal frame (18) includes a sash member (22) with an inwardly facing surface (66) and a casing member (24) with an inwardly facing surface (72); and (b) the cover piece (21) includes a sash cover (64) coextensive with the inwardly facing surface (66) and a casing cover (70) coextensive with the inwardly facing surface (72).

5. The wall opening frame member (79) specified in claims 1 or 2 wherein (a) the metal frame (18) has surfaces defining a glazing channel (30) adapted to receive a selected number of panes of glass (32) to form a window;

(b) the metal frame (18) has an inwardly facing surfaces (66, 72);

(c) a metal bead (78) having interior facing surfaces (82) is adapted to be attached to the metal frame (18) and to extend from the glazing channel (30) interiorly for a selected distance; and (d) the wood facing (20) includes a cover piece (21) coextensive with the inwardly facing surfaces (66, 72) of metal frame (18) and a bead cover (81) coextensive with the interior facing surfaces (82) of the metal bead (78), whereby no continuous metal heat transfer path exists between the exterior side (14) and the interior ambient air uninterrupted by the wood facing (20).

* * * * *